US011300018B2

(12) United States Patent
Kunitake et al.

(10) Patent No.: US 11,300,018 B2
(45) Date of Patent: Apr. 12, 2022

(54) HOLLOW EXHAUST POPPET VALVE

(71) Applicant: NITTAN VALVE CO., LTD., Hadano Kanagawa (JP)

(72) Inventors: Koji Kunitake, Hadano Kanagawa (JP); Jin Hasegawa, Ayase Kanagawa (JP); Yuki Sasagawa, Hiratsuka Kanagawa (JP)

(73) Assignee: NITTAN VALVE CO., LTD., Hadano Kanagawa (JP)

( * ) Notice: Subject to any disclaimer, the term of this patent is extended or adjusted under 35 U.S.C. 154(b) by 0 days.

(21) Appl. No.: 17/026,175

(22) Filed: Sep. 19, 2020

(65) Prior Publication Data

US 2021/0003044 A1 Jan. 7, 2021

Related U.S. Application Data

(63) Continuation-in-part of application No. PCT/JP2018/010980, filed on Mar. 20, 2018.

(51) Int. Cl.
*F01P 1/08* (2006.01)
*F01L 3/14* (2006.01)
(Continued)

(52) U.S. Cl.
CPC *F01L 3/14* (2013.01); *F01L 3/06* (2013.01); *F02F 1/24* (2013.01)

(58) Field of Classification Search
CPC ..... F01L 3/14; F01L 3/06; F01L 1/24
(Continued)

(56) References Cited

U.S. PATENT DOCUMENTS 1,356,311 A 10/1920 Reilly
1,402,720 A 1/1922 Bartlett
(Continued)

FOREIGN PATENT DOCUMENTS

DE 718717 3/1942
DE 2240572 2/1974
(Continued)

OTHER PUBLICATIONS

International Search Report dated Jun. 12, 2018 in PCT/JP2018/010980 which published as WO/2019/180806 A1 on Sep. 26, 2019 and which is the International Application of which the present application is a continuation-in-part. Submitted in lieu of translation for Fm Pat Doc Cite Nos. 6 and 7; submitted additionally for Fm Pat Doc Cite Nos. 2-5.
(Continued)

*Primary Examiner* — Logan M Kraft
*Assistant Examiner* — Anthony Donald Taylor, Jr.
(74) *Attorney, Agent, or Firm* — JTT Patent Services, LLC; Gerald T. Peters

(57) ABSTRACT

In a hollow exhaust poppet valve including a fillet increasing in diameter toward a leading end, a stem, and a head and having a coolant within a hollow part formed from the head to the stem, the stem includes a first stem part on a base end side, and a second stem part integrated with the first stem part via a step part and integrated with the fillet, and the hollow part includes a first hollow part formed inside the first stem part, and a second hollow part formed inside the second stem part, the fillet, and the head in such fashion as to have a constant inner diameter greater than the first hollow part and formed so as to be continuous with the first hollow part via a tapered part or a curved part.

10 Claims, 5 Drawing Sheets

(51) Int. Cl.
*F01L 3/06* (2006.01)
*F02F 1/24* (2006.01)

(58) Field of Classification Search
USPC ..... 123/41.41
See application file for complete search history.

(56) References Cited

U.S. PATENT DOCUMENTS 1,414,997 A 5/1922 Zinn
1,670,965 A 5/1928 Heron
1,714,690 A 5/1929 Nevins
1,727,621 A 9/1929 Taub
1,809,201 A 6/1931 Higgins
1,914,340 A 6/1933 Holzwarth
1,984,728 A 12/1934 Colwell
1,984,751 A 12/1934 McBride et al.
2,009,996 A 8/1935 Gering, Jr.
2,086,420 A 7/1937 Jardine
2,119,042 A 5/1938 Charlton
2,183,254 A 12/1939 Charlton
2,238,628 A 4/1941 Daisley
2,274,667 A 3/1942 Colwell
2,276,552 A 3/1942 Weber, Jr.
2,280,758 A 4/1942 Voorhies
2,365,285 A 12/1944 McDill
2,369,063 A 2/1945 McDill
2,371,548 A 3/1945 Saffady
2,392,175 A 1/1946 Norton
2,403,926 A 7/1946 Thompson
2,407,561 A 9/1946 Lincoln
2,410,190 A 10/1946 Townhill
2,411,764 A 11/1946 Thoren
2,435,948 A 2/1948 Wischhusen
2,439,240 A 4/1948 Cummings
2,450,803 A 10/1948 Johnson
2,452,628 A 11/1948 Bartlett et al.
2,453,642 A 11/1948 Emil
2,471,937 A 5/1949 Colwell
2,544,605 A 3/1951 Mallory
2,627,259 A 2/1953 Wood et al.
2,636,255 A 4/1953 Jeudy
2,668,719 A 2/1954 Harmon
2,682,261 A 6/1954 Achor
2,698,754 A 1/1955 Bernstein
2,731,708 A 1/1956 Kubera
2,734,008 A 2/1956 Kirkpatrick et al.
2,736,560 A 2/1956 Meibuhr
2,798,831 A 7/1957 Willcox
2,948,052 A 8/1960 Kubera
2,949,907 A * 8/1960 Tauschek ..... F01L 3/14 123/188.1
RE24,903 E 12/1960 Smith
2,966,363 A 12/1960 Hendrickson
3,132,871 A 5/1964 Stewart
3,313,277 A 4/1967 Adolfsson et al.
3,395,927 A 8/1968 Hammond
3,426,741 A 2/1969 Haagen
3,659,863 A 5/1972 Buttner
3,710,773 A 1/1973 Piesch et al.
3,826,301 A 7/1974 Brooks
4,147,138 A 4/1979 Haug
4,191,558 A 3/1980 Gould
4,300,492 A 11/1981 Hansueli
4,346,870 A 8/1982 Chute et al.
4,351,292 A 9/1982 Worthen et al.
4,362,134 A 12/1982 Worthen et al.
4,693,088 A 9/1987 Latge
4,726,717 A 2/1988 Schmid
4,741,080 A 5/1988 Larson et al.
4,762,447 A 8/1988 Marantette
4,834,036 A 5/1989 Nishiyama
5,056,219 A 10/1991 Iwase
5,077,876 A 1/1992 McConkey
5,168,843 A 12/1992 Franks
5,297,746 A 3/1994 McBride
5,346,184 A 9/1994 Ghosh
5,358,212 A 10/1994 Soltys
5,381,847 A 1/1995 Ashok
5,413,073 A 5/1995 Larson et al.
5,458,314 A 10/1995 Bonesteel
5,611,306 A 3/1997 Takano
5,619,796 A 4/1997 Larson et al.
5,649,358 A 7/1997 Adachi
5,765,520 A 6/1998 Adachi
5,769,037 A * 6/1998 Ohtsubo ..... F01L 3/14 123/188.9
5,771,852 A 6/1998 Heimann, Jr.
5,823,158 A 10/1998 Heimann, Jr. et al.
5,957,467 A 9/1999 Hornung
6,073,912 A 6/2000 Morii et al.
6,086,652 A 7/2000 Mulvaney, III
6,105,261 A 8/2000 Ecer
6,138,351 A 10/2000 Adachi
6,263,849 B1 7/2001 Bonesteel et al.
6,378,543 B1 4/2002 Murayama
6,679,478 B2 1/2004 Murayama
6,688,207 B2 2/2004 Tabeling
6,912,984 B2 * 7/2005 Narasimhan ..... F01L 3/02 123/188.3
6,951,579 B2 10/2005 Koyama
7,160,468 B2 1/2007 Matsuzaki
7,311,068 B2 12/2007 Jackson
7,344,655 B1 3/2008 Nishii et al.
8,230,834 B2 7/2012 Endo
8,881,391 B2 * 11/2014 Morii ..... B21C 23/183 29/888.45
9,061,389 B2 6/2015 Uchiuzo
9,175,788 B2 11/2015 Onuma et al.
9,255,559 B2 * 2/2016 Kroos ..... B60G 21/0555
9,284,911 B2 3/2016 Tomita
9,611,953 B2 4/2017 Tsuneishi
9,689,506 B2 6/2017 Homma et al.
9,751,164 B2 9/2017 Ishii et al.
9,790,822 B2 10/2017 Tsuneishi et al.
9,840,948 B2 12/2017 Yokoyama et al.
9,920,663 B2 3/2018 Tsuneishi
10,287,933 B2 5/2019 Ikemi et al.
10,316,390 B2 6/2019 Uchida et al.
10,569,318 B2 2/2020 Takahashi et al.
10,710,153 B2 7/2020 Uchida et al.
10,799,957 B2 10/2020 Okuno
2002/0036280 A1 3/2002 Murayama
2004/0112327 A1 6/2004 Spiegel
2004/0261746 A1 12/2004 Narasimhan et al.
2005/0252338 A1 11/2005 Henmi
2006/0162686 A1 7/2006 Heigl
2007/0089471 A1 4/2007 Otaki
2007/0240696 A1 10/2007 Jackson
2007/0241302 A1 10/2007 Kishihara et al.
2008/0006793 A1 1/2008 Hirnschal
2009/0020082 A1 1/2009 Suzuki et al.
2009/0206559 A1 8/2009 Nguyen
2009/0266314 A1 10/2009 Uchiyama et al.
2010/0126319 A1 5/2010 Mader
2010/0269778 A1 10/2010 Yuen
2011/0030526 A1 2/2011 Miyazaki
2011/0174259 A1 * 7/2011 Yoshimura ..... B23P 15/002 123/188.2
2011/0186000 A1 8/2011 Endo
2012/0042859 A1 2/2012 Sakai
2012/0124844 A1 5/2012 Droese
2012/0246934 A1 10/2012 Morii
2012/0246936 A1 10/2012 Morii
2012/0255175 A1 10/2012 Morii et al.
2012/0304464 A1 12/2012 Morii
2014/0014057 A1 1/2014 McGinnis
2014/0290617 A1 10/2014 Tomita
2014/0352803 A1 12/2014 Onuma et al.
2014/0366373 A1 * 12/2014 Morii ..... B23P 15/002 29/888.451
2015/0232964 A1 8/2015 Zhang
2015/0240675 A1 8/2015 Homma et al.
2015/0354727 A1 12/2015 Tsuneishi
2016/0053641 A1 4/2016 Tsuneishi

(56) References Cited

U.S. PATENT DOCUMENTS

| | | | | |
|---|---|---|---|---|
| 2016/0186620 | A1 | 6/2016 | Knudsen | |
| 2016/0256965 | A1* | 9/2016 | Ishii | F01L 3/14 |
| 2016/0279746 | A1* | 9/2016 | Mishima | B21C 23/002 |
| 2016/0326919 | A1* | 11/2016 | Ikemi | F01L 3/18 |
| 2016/0348546 | A1 | 12/2016 | Kurahashi et al. | |
| 2016/0356186 | A1* | 12/2016 | Tsuneishi | F01L 3/02 |
| 2017/0234175 | A1* | 8/2017 | Morii | F01L 3/14 123/188.3 |
| 2017/0276031 | A1 | 9/2017 | Yokoyama et al. | |
| 2018/0104730 | A1 | 4/2018 | Takahashi et al. | |
| 2018/0142324 | A1 | 5/2018 | Uchida et al. | |
| 2019/0030595 | A1 | 1/2019 | Uchida et al. | |
| 2019/0240743 | A1 | 8/2019 | Okuno | |

FOREIGN PATENT DOCUMENTS

| | | | | | |
|---|---|---|---|---|---|
| DE | 2727006 | A1 | | 12/1978 | |
| DE | 19826885 | A1 | | 12/1999 | |
| DE | 202016004635 | | | 8/2016 | |
| DE | 102015220891 | A1 | | 11/2021 | |
| EP | 0619419 | A1 | | 3/1994 | |
| EP | 0911493 | A2 | | 4/1999 | |
| EP | 1070831 | A2 | | 1/2001 | |
| EP | 1152127 | A1 | | 11/2001 | |
| EP | 1353044 | A2 | | 10/2003 | |
| EP | 1462621 | A1 | | 9/2004 | |
| FR | 490855 | | | 5/1919 | |
| GN | 203700465 | | | 7/2014 | |
| JP | S52-073306 | U | | 6/1977 | |
| JP | S52-111813 | U | | 8/1977 | |
| JP | S55-025679 | U | | 2/1980 | |
| JP | S59-023856 | A | | 2/1984 | |
| JP | S60-087314 | U | | 6/1985 | |
| JP | S60-097213 | U1 | | 7/1985 | |
| JP | S61-042208 | U1 | | 3/1986 | |
| JP | S61-084347 | A | | 4/1986 | |
| JP | S61-106677 | U | | 7/1986 | |
| JP | S62-062071 | A | | 3/1987 | |
| JP | S62-102806 | U | | 6/1987 | |
| JP | S63-033167 | A | | 2/1988 | |
| JP | S63-109207 | A | | 5/1988 | |
| JP | 63264237 | A | * | 11/1988 | F01L 3/02 |
| JP | S63-264237 | A | | 11/1988 | |
| JP | S64-083676 | A | | 3/1989 | |
| JP | H01 -037466 | B2 | | 8/1989 | |
| JP | H1-173305 | U | | 12/1989 | |
| JP | H01-173417 | U | | 12/1989 | |
| JP | 02005704 | A | * | 1/1990 | F01L 3/02 |
| JP | H02-005704 | A | | 1/1990 | |
| JP | H02-124204 | A | | 5/1990 | |
| JP | H02-020411 | Y2 | | 6/1990 | |
| JP | H02-033848 | B2 | | 7/1990 | |
| JP | H02-124204 | U | | 10/1990 | |
| JP | H03-018605 | A | | 1/1991 | |
| JP | H03-023607 | U | | 3/1991 | |
| JP | H03-052309 | U | | 5/1991 | |
| JP | H03-170210 | A | | 7/1991 | |
| JP | 1991-242408 | A | | 10/1991 | |
| JP | H03242408 | | * | 10/1991 | B21K 1/22 |
| JP | 1991-258903 | A | | 11/1991 | |
| JP | H04-065907 | U | | 6/1992 | |
| JP | H4-76907 | U | | 7/1992 | |
| JP | H0476907 | U | * | 7/1992 | F01L 3/14 |
| JP | H04-232318 | B2 | | 8/1992 | |
| JP | H04-272413 | A | | 9/1992 | |
| JP | 1992-314906 | A | | 11/1992 | |
| JP | H04-311611 | A | | 11/1992 | |
| JP | H05-071316 | A | | 3/1993 | |
| JP | H5-141214 | A | | 6/1993 | |
| JP | H06-299816 | A | | 10/1994 | |
| JP | H07-204909 | A | | 8/1995 | |
| JP | H07-279627 | A | | 10/1995 | |
| JP | H08-176752 | A | | 7/1996 | |
| JP | 2789390 | B2 | | 8/1998 | |
| JP | H11-032525 | A | | 2/1999 | |
| JP | H11-117718 | A | | 4/1999 | |
| JP | H11-210429 | A | | 8/1999 | |
| JP | 2000-045730 | A | | 2/2000 | |
| JP | 3018260 | B2 | | 3/2000 | |
| JP | 2001-059408 | A | | 3/2001 | |
| JP | 2001-234714 | A | | 8/2001 | |
| JP | 2001-323323 | A | | 11/2001 | |
| JP | 2002-292164 | A | | 10/2002 | |
| JP | 2003-103355 | A | | 4/2003 | |
| JP | 2003-307105 | A | | 10/2003 | |
| JP | 2004-106109 | A | | 4/2004 | |
| JP | 2004-301124 | A | | 10/2004 | |
| JP | 2004-306204 | A | | 11/2004 | |
| JP | 2006-002578 | A | | 1/2006 | |
| JP | 2006-097498 | A | | 4/2006 | |
| JP | 2006-097499 | A | | 4/2006 | |
| JP | 2006-516313 | A | | 6/2006 | |
| JP | 2006-183528 | A | | 7/2006 | |
| JP | 2006-274917 | A | | 10/2006 | |
| JP | 2007-285186 | A | | 11/2007 | |
| JP | 2008-014237 | A | | 1/2008 | |
| JP | 2008-088815 | A | | 4/2008 | |
| JP | 2008-138649 | A | | 6/2008 | |
| JP | 4227551 | B2 | | 2/2009 | |
| JP | 2011-157845 | A | | 8/2011 | |
| JP | 2011-179327 | A | | 9/2011 | |
| JP | 2011-179328 | A | | 9/2011 | |
| JP | 2011-184260 | A | | 9/2011 | |
| JP | 2012-072748 | A | | 4/2012 | |
| JP | 2012-112358 | A | | 6/2012 | |
| JP | 2012-136978 | A | | 7/2012 | |
| JP | 2012-136979 | A | | 7/2012 | |
| JP | 2012-197718 | A | | 10/2012 | |
| JP | 2013-112550 | A | | 6/2013 | |
| JP | 2013-155676 | A | | 8/2013 | |
| JP | 2013-180536 | A | | 9/2013 | |
| JP | 2015-036171 | A | | 2/2015 | |
| JP | 5735721 | B1 | | 6/2015 | |
| JP | 2017-008835 | A | | 1/2017 | |
| JP | 2017-190759 | A | | 11/2021 | |
| KR | 20-1996-0023080 | U | | 7/1996 | |
| WO | 2000047876 | A1 | | 8/2000 | |
| WO | 2007057946 | A1 | | 5/2007 | |
| WO | 2010041337 | A1 | | 4/2010 | |
| WO | 2010119977 | A1 | | 10/2010 | |
| WO | 2011/104916 | A1 | | 9/2011 | |
| WO | 2011104912 | A1 | | 9/2011 | |
| WO | 2011104923 | A1 | | 9/2011 | |
| WO | 2012026011 | A1 | | 3/2012 | |
| WO | 2012086315 | A1 | | 6/2012 | |
| WO | 2012086316 | A1 | | 6/2012 | |
| WO | 2013080389 | A1 | | 6/2013 | |
| WO | 2013145250 | A1 | | 10/2013 | |
| WO | 2014054113 | A1 | | 4/2014 | |
| WO | 2014054302 | A1 | | 4/2014 | |
| WO | 2014054613 | A1 | | 4/2014 | |
| WO | 2014122858 | A1 | | 8/2014 | |
| WO | 2014141416 | A1 | | 9/2014 | |
| WO | 2014155665 | A1 | | 10/2014 | |
| WO | 2014155667 | A1 | | 10/2014 | |
| WO | 2014167694 | A1 | | 10/2014 | |
| WO | 2015075795 | A1 | | 5/2015 | |
| WO | 2015098643 | A1 | | 7/2015 | |
| WO | 2015118690 | A1 | | 8/2015 | |
| WO | 2015/170384 | A1 | | 11/2015 | |
| WO | 2014147759 | A1 | | 2/2017 | |
| WO | 2015121920 | A1 | | 3/2017 | |
| WO | 2017072885 | A1 | | 5/2017 | |
| WO | 2017130375 | A1 | | 8/2017 | |
| WO | 2017130376 | A1 | | 8/2017 | |
| WO | 2017141305 | A1 | | 8/2017 | |
| WO | 2018105009 | A1 | | 6/2018 | |

OTHER PUBLICATIONS

International Preliminary Report on Patentability dated Oct. 15, 2019 in PCT/JP2018/010980 which published as WO/2019/180806

(56) References Cited

OTHER PUBLICATIONS

A1 on Sep. 26, 2019 and which is the International Application of which the present application is a continuation-in-part. Submitted in lieu of translation for Frn Pat Doc Cite Nos. 6 and 7; submitted additionally for Frn Pat Doc Cite Nos. 2-5.

Applicant brings to the attention of the Examiner the existence of related U.S. Appl. No. 09/582,205, filed Jul. 17, 2000 and issued as U.S. Pat. No. 6,378,543 B2 on Apr. 30, 2002, which was the national stage of Intl App No. PCT/JP1999/00590 filed on Feb. 12, 1999 and published as WO 2000/47876 A1 on Aug. 17, 2000, and which has overlapping inventorship/ownership as in the present case.

Applicant brings to the attention of the Examiner the existence of related U.S. Appl. No. 10/003,202, filed Dec. 6, 2001 and published as US 2002 036280 A1 on Mar. 28, 2002 and issued as U.S. Pat. No. 6,679,478 on Jan. 20, 2004, which was a divisional of U.S. Appl. No. 09/582,205, filed Jul. 17, 2000 and issued as U.S. Pat. No. 6,378,543 B2 on Apr. 30, 2002, which was the national stage of Intl App No. PCT/JP1999/00590 filed on Feb. 12, 1999 and published as WO 2000/47876 A1 on Aug. 17, 2000, and which has overlapping inventorship/ownership as in the present case.

Applicant brings to the attention of the Examiner the existence of related U.S. Appl. No. 12/516,963, filed Oct. 10, 2008 and published as US 2011 0186000 A1 on Aug. 4, 2011 and issued as U.S. Pat. No. 8,230,834 B2 on Jul. 31, 2012, which was the national stage of Intl App No. PCT/JP2008/068498 filed on Oct. 10, 2008 and published as WO 2010/041337 A1 on Apr. 15, 2010, and which has overlapping inventorship/ownership as in the present case.

Applicant brings to the attention of the Examiner the existence of related U.S. Appl. No. 14/361,636, filed Oct. 2, 2012 and published as US 2014 0352803 A1 on Dec. 4, 2014 and issued as U.S. Pat. No. 9,175,788 on Nov. 3, 2015, which was the national stage of International Application No. PCT/JP2012/075452 filed on Oct. 2, 2012 and published as WO 2014054113 A1 on Apr. 10, 2014, and which has overlapping inventorship/ownership as in the present case.

Applicant brings to the attention of the Examiner the existence of related U.S. Appl. No. 14/759,850, filed Mar. 14, 2013 and published as US 2015 0354727 A1 on Dec. 10, 2015 and issued as U.S. Pat. No. 9,611,953 B2 on Apr. 4, 2017, which was the national stage of Intl App No. PCT/JP2013/057133 filed on Mar. 14, 2013 and published as WO 2014 141416 A1 on Sep. 18, 2014, and which has overlapping inventorship/ownership as in the present case.

Applicant brings to the attention of the Examiner the existence of related U.S. Appl. No. 14/783,492, filed Apr. 11, 2013 and published as US 2016 0053641 A1 on Feb. 25, 2016 and issued as U.S. Pat. No. 9,920,663 B2 on Mar. 20, 2018, which was the national stage of International Application No. PCT/JP2013/060977 filed on Apr. 11, 2013 and published as WO 2014 167694 A1 on Oct. 16, 2014, and which has overlapping inventorship/ownership as in the present case.

Applicant brings to the attention of the Examiner the existence of related U.S. Appl. No. 14/431,657, filed Mar. 26, 2013 and published as US 2015 0240675 A1 on Aug. 27, 2015 and issued as U.S. Pat. No. 9,689,506 on Jun. 27, 2017, which was the national stage of International Application No. PCT/JP2013/058883 filed on Mar. 26, 2013 and published as WO 2014 054302 A1 on Apr. 10, 2014, and which has overlapping inventorship/ownership as in the present case.

Applicant brings to the attention of the Examiner the existence of related U.S. Appl. No. 15/035,955, filed Nov. 21, 2013 and published as US 2016 0256965 A1 on Sep. 8, 2016 and issued as U.S. Pat. No. 9,751,164 B2 on Sep. 5, 2017, which was the national stage of International Application No. PCT/JP2013/081352 filed on Nov. 21, 2013 and published as WO 2015 075795 A1 on May 28, 2015, and which has overlapping inventorship/ownership as in the present case.

Applicant brings to the attention of the Examiner the existence of related U.S. Appl. No. 15/108,470, filed dec. 17, 2014 and published as US 2016 0326919 A1 on Nov. 10, 2016 and issued as U.S. Pat. No. 10,287,933 B2 on May 14, 2019, which was the national stage of International Application No. PCT/JP2014/083372 filed on Dec. 17, 2014 and published as WO 2015 098643 A1 on Jul. 2, 2015, and which has overlapping inventorship/ownership as in the present case.

Applicant brings to the attention of the Examiner the existence of related U.S. Appl. No. 15/114,460, filed Feb. 10, 2014 and published as US 2016 0356186 A1 on Dec. 8, 2016 and issued as U.S. Pat. No. 9,790,822 B2 on Oct. 17, 2017, which was the national stage of Intl App No. PCT/JP2014/053086 filed on Feb. 10, 2014 and published as WO 2015 118690 A1 on Aug. 13, 2015, and which has overlapping inventorship/ownership as in the present case.

Applicant brings to the attention of the Examiner the existence of related U.S. Appl. No. 15/504,845, filed Oct. 28, 2015 and published as US 2017 0276031 A1 on Sep. 28, 2017 and issued as U.S. Pat. No. 9,840,948 B2 on Dec. 12, 2017, which was the national stage of Intl Appl No. PCT/JP2015/080433 filed on Oct. 28, 2015 and published as WO 2017 072885 A1 on May 4, 2017, and which has overlapping inventorship/ownership as in the present case.

Applicant brings to the attention of the Examiner the existence of related U.S. Appl. No. 15/564,332, filed Jan. 29, 2016 and published as US 2018 0142324 A1 on May 24, 2018 and issued as U.S. Pat. No. 10,316,390 B2 on Jun. 11, 2019, which was the national stage of International Application No. PCT/JP2016/052635 filed on Jan. 29, 2016 and published as WO 2017 130375 A1 on Aug. 3, 2017, and which has overlapping inventorship/ownership as in the present case.

Applicant brings to the attention of the Examiner the existence of related U.S. Appl. No. 16/072,617, filed Jan. 29, 2016 and published as US 2019 0030595 A1 on Jan. 31, 2019 and issued as U.S. Pat. No. 10,710,153 on Jul. 14, 2020, which was the national stage of Intl App No. PCT/JP2016/052636 filed on Jan. 29, 2016 and published as WO 2017 130376 A1 on Aug. 3, 2017 and which has overlapping inventorship/ownership as in the present case.

Applicant brings to the attention of the Examiner the existence of related U.S. Appl. No. 15/540,930, filed Feb. 15, 2016 and published as US 2018 0104730 A1 on Apr. 19, 2018 and issued as U.S. Pat. No. 10,569,318 B2 on Feb. 25, 2020, which was the national stage of Intl App No. PCT/JP2016/054252 filed on Feb. 15, 2016 and published as WO 2017 141305 A1 on Aug. 24, 2017, and which has overlapping inventorship/ownership as in the present case.

Applicant brings to the attention of the Examiner the existence of related U.S. Appl. No. 16/340,871, filed Dec. 5, 2016 and published as US 2019 0240743 A1 on Aug. 8, 2019 and issued as U.S. Pat. No. 10,799,957 B2 on Oct. 13, 2020, which was the national stage of International Application No. PCT/JP2016/086076 filed on Dec. 5, 2016 and published as WO 2018105009 A1 on Jun. 14, 2018, and which has overlapping inventorship/ownership as in the present case.

International Search Report dated Nov. 11, 2008 in Intl App No. PCT/JP2008/068498 filed on Oct. 10, 2008, the national stage of which was US Patent Application No. 112516963 filed on Oct. 10, 2008, which issued as U.S. Pat. No. 8,230,834 B2 on Jul. 31, 2012, and which published as WO 2010/041337 A1 on Apr. 15, 2010 and as US 2011 0186000 A1 on Aug. 4, 2011.

International Search Report dated Nov. 13, 2012 in Intl App No. PCT/JP2012/075452 filed on Oct. 2, 2012, the national stage of which was U.S. Appl. No. 14/361,636, filed Oct. 2, 2012, which issued as U.S. Pat. No. 9,175,788 on Nov. 3, 2015, and which published as WO 2014/054113 A1 on Apr. 10, 2014 and as US 2014 0352803 A1 on Dec. 4, 2014.

International Search Report dated Mar. 25, 2014 in Intl App No. PCT/JP2014/053086 filed on Feb. 10, 2014, the national stage of which was U.S. Appl. No. 15/114,460, filed Feb. 10, 2014, which issued as U.S. Pat. No. 9,790,822 B2 on Oct. 17, 2017, and which published as WO 2015 118690 A1 on Aug. 13, 2015 and as US 2016 0356186 A1 on Dec. 8, 2016.

International Search Report of Feb. 14, 2017 in Intl App No. PCT/JP2016/086076 filed on Dec. 5, 2016, the national stage of which was U.S. Appl. No. 16/340,871, filed Dec. 5, 2016, which issued as U.S. Pat. No. 10,799,957 B2 on Oct. 13, 2020, and which published as WO 2018 105009 A1 on Jun. 14, 2018 and as US 2019 0240743 A1 on Aug. 8, 2019.

(56) References Cited

OTHER PUBLICATIONS

International Search Report and Written Opinion of the International Searching Authority dated May 10, 2016 in Intl App No. PCT/JP2016/052635 filed on Jan. 29, 2016, the national stage of which was U.S. Appl. No. 15/564,332, filed Jan. 29, 2016, which issued as U.S. Pat. No. 10,316,390 B2 on Jun. 11, 2019, and which published as WO 2017 130375 A1 on Aug. 3, 2017 and as US 2018 0142324 A1 on May 24, 2018.
International Search Report and Written Opinion in Intl App No. PCT/JP2016/052636 filed on Jan. 29, 2016 and published as WO 2017 130376 A1 on Aug. 3, 2017.
Written Opinion of the International Searching Authority dated May 17, 2016 in Intl App No. PCT/JP2016/054252 filed on Feb. 15, 2016, the national stage of which was U.S. Appl. No. 15/540,930, filed Feb. 15, 2016, which issued as U.S. Pat. No. 10,569,318 B2 on Feb. 25, 2020, and which published as WO 2017 141305 A1 on Aug. 24, 2017 and as US 2018 0104730 A1 on Apr. 19, 2018.
International Search Report of Feb. 21, 2006 in Intl App No. PCT/JP2005/020975 filed on May 12, 2008 and published as WO 2007/057946 A1.
International Search Report of May 7, 2013 in Intl App No. PCT/JP2013/058883 filed on Mar. 26, 2013 and published as WO 2014 054302 A1 on Apr. 10, 2014.
International Search Report of May 7, 2013 in Intl App No. PCT/JP2013/057133 filed on Mar. 14, 2013 and published as WO 2014 141416 A1 on Sep. 18, 2013.
International Search Report dated Jun. 4, 2013 in Intl App No. PCTJP2013060977 filed on Apr. 11, 2013 and published as WO 2014 167694 A1.
International Search Report dated Mar. 25, 2014 in Intl App No. PCT/JP2014/053156 filed on Feb. 12, 2014 and published as WO 2015 121920 A1 on Mar. 30, 2017.
EP Search Report dated Oct. 28, 2009 in EP Pat App No. 05806844.6 which is EP counterpart of U.S. Appl. No. 12/093,364, filed Nov. 15, 2005.
Extended EP Search Report dated Jun. 24, 2016 in EP Pat App No. 13843227.3 which is EP counterpart of U.S. Appl. No. 14/431,657, filed Mar. 26, 2013.
OA of May 4, 2020 in U.S. Appl. No. 16/340,871.
OA of May 13, 2020 in U.S. Appl. No. 16/072,617.
Web page at http://www.landinst.jp/info/faq/faq3.html as of Aug. 8, 2016 as retrieved from Internet Archive via URL https://web.archive.org/web/20150201000000*/http://www.landinst.jp/info/faq/faq3.html on Feb. 24, 2021.
Web page at http://www.fintech.co.jp/etc-data/housharitsu.htm as of Aug. 8, 2016 as retrieved from Internet Archive via URL https://web.archive.org/web/20161101000000*/http://www.fintech.co.jp/etc-data/houshartsu.htm on Feb. 24, 2021.
Applicant brings to the attention of the Examiner the existence of possibly related U.S. Appl. No. 17/317,773, filed May 11, 2021 and published as US 2021 0270154 A1 on Sep. 2, 2021, which is a bypass CIP of International Application No. PCT/JP2018/041807 filed on Nov. 12, 2018 and published as WO 2020/100185 A1 on May 22, 2020, and which has overlapping inventorship/ownership as in the present case.

* cited by examiner (a)

(b)

HOLLOW EXHAUST POPPET VALVE

CROSS-REFERENCE TO RELATED APPLICATION, BENEFIT CLAIM, AND INCORPORATION BY REFERENCE

This application is a continuation-in-part of and claims benefit under 35 USC 120 and 365(c) to copending International Application No. PCT/JP2018/010980, entitled "Hollow Exhaust Poppet Valve", filed 20 Mar. 2018, the content of which is incorporated herein in its entirety by reference.

FIELD OF THE INVENTION

The present invention relates to a hollow exhaust poppet valve in which a hollow part formed at the interior of a region from a valve head to a valve stem is at least partially filled with coolant.

BACKGROUND

Hollow valves for engines may broadly speaking be understood to include what will be referred to herein as hollow-stem valves (which should not be understood to imply that the head portion of such a valve is necessarily solid) in which coolant is present within a hollow part formed so as to have a constant inner diameter from the valve stem to a region inside the valve head, and hollow-head valves (which should not be understood to imply that the stem portion of such a valve is necessarily solid) in which coolant is present within a hollow part which is located inside the valve head and which is formed into a shape that follows the contour of the outer surface of the valve head.

Whereas hollow-stem valves have constant inner diameter, which may permit coolant to easily move in an axial direction of the valve as a result of axial movement of the valve, with hollow-stem valves it is sometimes the case that insufficiency in the amount of coolant with which the hollow-stem valve may be filled and limitations regarding the rate of heat transfer that the coolant is capable of achieving may result in insufficient heat transfer from the valve to the coolant, as a result of which it may be that sufficient cooling effect is not obtained.

Whereas hollow-head valves in which a hollow head portion is formed into a shape that follows the contour of the outer surface of the valve head at the leading end of a hollow stem portion of constant internal diameter will make it possible to expand the capacity of the hollow part as compared with the capacity of the hollow part of a comparable hollow-stem valve, which may permit increase in the amount of coolant with which the hollow-head valve may be filled and increase in the rate of heat transfer that the hollow-head valve is capable of achieving for sufficient cooling effect during high-speed rotation of an engine, with hollow-head valves it is sometimes the case that much effort is required to cause the hollow part to be formed such that the shape thereof at the interior of the valve head follows the contour of the exterior of the valve head in the region where the valve stem transitions in continuous fashion to the valve head, for which reason a hollow poppet valve such as might provide sufficient cooling effect but be simpler in form has been desired.

Particularly, in recent years, because there are engines which are used only as generators to supply electric power to electric drive motors that provide the motive force for vehicle travel without themselves being used to provide the motive force for vehicle travel, and because such engines generate electric power only at low and/or medium rotational speeds without rotating at high speed, this has resulted in demand for a hollow exhaust poppet valve such as might produce good cooling effect during low and/or medium rotational speeds rather than at high rotational speeds so as to achieve increased knock resistance and improved fuel efficiency.

SUMMARY OF INVENTION

One or more embodiments of the present invention may address the foregoing and/or other market needs by providing a hollow exhaust poppet valve having a simple structure and producing a cooling effect equivalent to or better than that of a hollow-head valve during low and/or medium rotational speeds of an engine.

For example, in accordance with one embodiment of a hollow exhaust poppet valve including a stem and a head integrated via a fillet that increases in diameter toward a leading end and having coolant within a hollow part formed from the head to the stem, the stem may include a first stem part on a base end side, and a second stem part integrated with the first stem part via a step part and integrated with the fillet, and the hollow part may include a first hollow part formed inside the first stem part, and a second hollow part formed inside the second stem part, the fillet, and the head so as to have a constant inner diameter greater than the first hollow part and formed so as to be continuous with the first hollow part via a connecting portion, which might, for example, be a tapered part or a curved part.

In accordance with such an embodiment, it may be the case that while strength is retained in the second stem part, the fillet, and the head of the valve exposed to a combustion high-temperature combustion chamber during exhaust, the second hollow part disposed inside the second stem part, the fillet, and the head is expanded in capacity to increase the amount of coolant with which a portion exposed to high temperature of exhaust may be filled and thereby increase the rate of heat transfer that is capable of being achieved, and therefore, heat is smoothly transferred from the combustion chamber to the coolant, and the coolant is shaken in the axial direction of the valve inside the second hollow part having the constant inner diameter during fast oscillation of the valve and therefore hardly remains on the inner wall of the second hollow part, so that smooth movement to and from the first hollow part is facilitated via the curved part, tapered part, or other such connecting portion.

When an engine using a coolant-containing hollow-stem valve is operated in a low and/or medium rotational speed range, and the coolant having heat transferred from the vicinity of the head or the fillet in the hollow part moves to a region near a stem end part (valve stem leading end part 2) not directly exposed to the combustion chamber and therefore having a lower temperature, the coolant may be cooled to the melting point or less and tend to agglomerate in regions near the stem end part in the hollow part and may therefore cause deterioration in valve performance with respect to ability to dissipate heat. However, at an engine valve in accordance with one or more embodiments of the present invention, the inner diameter of the first hollow part near the stem end part and not exposed to the inside of the combustion chamber may be reduced as compared to the inner diameter of the second hollow part, and therefore, the amount of coolant that tends to agglomerate thereat may be decreased, so that the temperature of the valve may be reduced in the low and/or medium rotational speed range.

In the context of a hollow exhaust poppet valve in accordance with such an embodiment, the second stem part may be formed so as to have a wall thickness larger than the first stem part.

In accordance with such an embodiment, it may be the case that the rate of heat transfer that can be achieved at the second stem part itself increases, so that the rate of heat transfer from the combustion chamber to the coolant can be further improved.

The second hollow part is preferably in the shape of a plurality of hollow parts different in inner diameter and continuously arranged from a base end part to a leading end part in ascending order of inner diameter.

In accordance with such an embodiment, it may be the case that the hollow part having a larger inner diameter is formed so as to follow the outer shape of the fillet increasing in diameter toward the leading end part, and the amount of coolant with which the second hollow part may be filled further increases.

In some embodiments, the plurality of hollow parts different in inner diameter are respectively made continuous via connecting portions, which might, for example, be tapered part(s) and/or curved part(s).

In accordance with such an embodiment, it may be the case that smooth movement of the coolant is facilitated in the plurality of hollow parts due to tapered part(s), curved part(s), and/or other such connecting portion(s).

In the context of a hollow exhaust poppet valve in accordance with such an embodiment, the valve head may have a valve face configured to come into contact with a valve seat of a cylinder head at the time of closing of the valve, and an axial length from a base end part of the step part to a leading end part of the valve face may be made shorter than an axial length from a leading edge part of a valve guide opening part of the cylinder head to a leading end part of the valve seat.

In accordance with such an embodiment, it may be the case that the step part and the second stem part do not interfere with the valve guide opening part of the cylinder head at the time of opening/closing operation of the hollow exhaust poppet valve during exhaust.

Benefit of Invention

A hollow exhaust poppet valve in accordance with one or more embodiments of the present invention may be such that strength is not reduced in a portion exposed to high temperature, and since increase in the amount of coolant within the portion exposed to high temperature may permit increase in the rate of heat transfer that may be achieved by the coolant and improve the efficiency of movement of the coolant between the valve head and the valve stem, and since the inner diameter of the first hollow part may be made smaller than the second hollow part to reduce agglomeration of coolant in regions near the stem end part, the valve may produce a cooling effect equivalent to or better than that of a hollow-head valve during low and/or medium rotational speeds of the engine, and since the shape of the second hollow part may be a straight hole having a constant inner diameter, it may be the case that the second hollow part can easily be formed.

A hollow exhaust poppet valve of the present application in accordance with one or more embodiments of the present invention may be such that a portion thereof which is exposed to high temperature may be increased in wall thickness, as a result of which an increase in the rate of heat transfer that can be achieved by the second stem part itself may improve the rate of heat transfer from the combustion chamber to the coolant, so that the cooling effect due to the valve may be further improved.

A hollow exhaust poppet valve in accordance with one or more embodiments of the present invention may be such that a plurality of straight holes different in inner diameter are formed in ascending order of the inner diameter, as a result of which it may be that the second hollow part can easily be formed, and since it may be the case that the amount of coolant within the inside of the second hollow part that is exposed to high temperature may be further increased, it may be the case that the rate of heat transfer that can be achieved by the coolant is further increased.

A hollow exhaust poppet valve in accordance with one or more embodiments of the present invention may be such that a plurality of straight holes different in inner diameter is formed in ascending order of the inner diameter, as a result of which it may be that the second hollow part can easily be formed, and since it may be the case that the amount of coolant within the inside of the second hollow part that is exposed to high temperature may be further increased, and since the rate of heat transfer that can be achieved by the coolant may be further increased, it may be the case that the cooling effect of the valve is improved.

A hollow exhaust poppet valve in accordance with one or more embodiments of the present invention may be such that movement of coolant in the second hollow part is facilitated, as a result of which the efficiency of movement of the coolant may be further improved between the valve head and the valve stem, and the cooling effect of the valve may be improved.

A hollow exhaust poppet valve in accordance with one or more embodiments of the present invention may be such that the capacity of the second hollow part and the wall thickness of the second stem part can be made larger without causing interference of the step part and the second stem part with the valve guide opening part of the cylinder head at the time of opening/closing operation of the valve, in which case the rate of heat transfer from the combustion chamber to the coolant may be further improved.

BRIEF DESCRIPTION OF DRAWINGS

Many aspects of the invention can be better understood with reference to the attached drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
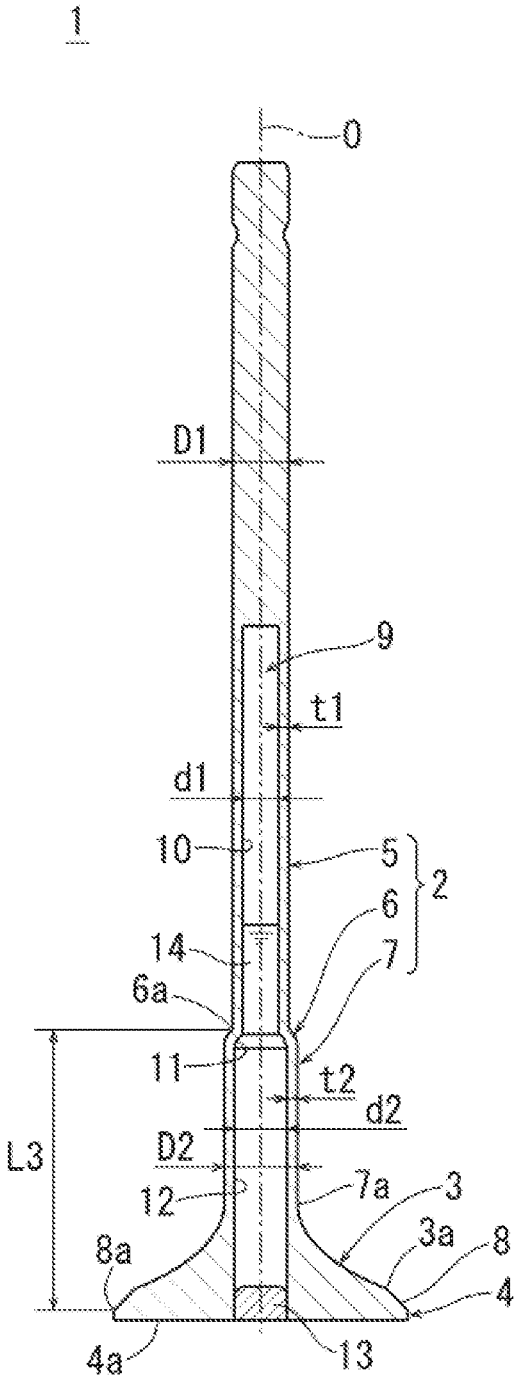
FIG. 1 is an axial cross-sectional view of a hollow exhaust poppet valve according to a first embodiment.

A first embodiment of a hollow exhaust poppet valve will be described with reference to FIG. 1. In FIG. 1, the valve head side and the valve stem side of the hollow exhaust poppet valve will be described as the leading end side and the base end side, respectively.

A hollow exhaust poppet valve 1 in the first embodiment illustrated in FIG. 1 includes a stem 2, a fillet 3, and a head 4 made of heat-resistant alloy(s) and/or the like having high heat resistance.

The stem 2 is made up of a first stem part 5, a step part 6, and a second stem part 7. The second stem part 7 is integrated with the first stem part 5 via the step part 6 formed into a convex curved shape that becomes narrower as one proceeds from the leading end side to the base end side, and an outer diameter D2 of the second stem part 7 is made larger than an outer diameter D1 of the first stem part 5 overall due to the step part 6. The fillet 3 is formed into a concave curved shape with an outer diameter gradually increased toward a leading end and is smoothly connected to a leading end part 7*a* of the second stem part 7. The head 4 has a taper-shaped valve face 8 spreading out from the base end side to the leading end side on the outer circumference, and the valve face 8 is connected to a leading end part 3*a* of the fillet 3. The step part 6 may be formed as a tapered part that tapers so as to become narrower as one proceeds from the leading end side to the base end side.

A hollow part 9 coaxial with a central axis O of the hollow exhaust poppet valve 1 is formed in the central portion inside the stem 2, the fillet 3, and the head 4. The hollow part 9 comprises a first hollow part 10, a curved part 11, and a second hollow part 12. The first hollow part 10 is formed inside the first stem part 5 of the stem 2 in such fashion as to have a constant inner diameter, and the second hollow part 12 is formed inside the second stem part 7, the fillet 3, and the head 4 in such fashion as to have a constant inner diameter d2 larger than an inner diameter d1 of the first hollow part 10.

The curved part 11 is a connecting portion. The curved part 11 has a concave curved shape that becomes narrower as one proceeds from the leading end side to the base end part, with a leading-end inner diameter of d2 and a base-end inner diameter of d1, and the second hollow part 12 is smoothly connected to the first hollow part 10 via the curved part 11. The first hollow part 10, the curved part 11, and the second hollow part 12 might be formed about the central axis O of the hollow exhaust poppet valve 1 by drilling or the like from a bottom surface 4*a* side of the hollow exhaust poppet valve 1. The hollow part 9 is closed by attaching a cap 13 made of a heat-resistant alloy or the like by resistance bonding or the like in such fashion that the interior thereof is made to contain a coolant such as metallic sodium. The curved part 11 may alternatively or additionally be formed as a tapered part that tapers so as to become narrower as one proceeds from the leading end side to the base end side.

The first stem part 5 might be formed by cutting an outer circumference of a bar made of heat-resistant metal to the outer diameter D1. In the first embodiment, a wall thickness t1 of the first stem part 5 is made coincident with a wall thickness t2 of the second stem part 7. Although the second hollow part 12 having the inner diameter larger than the first hollow part 10 of the first stem part 5 is formed inside, the second stem part 7 has the same wall thickness as the first stem part 5 and therefore produces an effect of improving heat transfer characteristics due to the increased amount of coolant 14 permitted thereby while maintaining strength.

At the hollow exhaust poppet valve 1 of the first embodiment, the second hollow part 12 is disposed inside the second stem part 7, the fillet 3, and the head 4 exposed to high-temperature exhaust gas of a combustion chamber and an exhaust gas port of an engine and has the inner diameter d2 made larger than the inner diameter d1 of the first hollow part 10, so that the second hollow part 12 that is exposed to high temperature is expanded in capacity so as to increase the amount of coolant 14 with which it may be at least partially filled and thereby increase the rate of heat transfer capable of being achieved thereby, as a result of which heat may be smoothly transferred from the combustion chamber to the coolant 14. Additionally, the coolant 14 is shaken back and forth along the central axis O of the valve inside the second hollow part 12 having the constant inner diameter d2 during fast oscillation of the hollow exhaust poppet valve 1 and therefore hardly remains on the inner wall of the second hollow part 12, so that smooth movement to and from the first hollow part 10 is facilitated via the curved part 11 that becomes narrower toward the first stem part 5 on the base end side and having the inner diameter at connection points made coincident with the first and second hollow parts (10, 12).

As a result, the hollow exhaust poppet valve 1 of the present embodiment is such that the efficiency of movement of the coolant 14 is improved between the head 4 and the stem 2, so that a cooling effect equivalent to or better than that of a hollow-head valve can be produced during low and/or medium rotational speeds of the engine, while the second hollow part 12 can easily be formed since the second hollow part 12 has a shape of a straight hole having the constant inner diameter d2.

Figure 2:
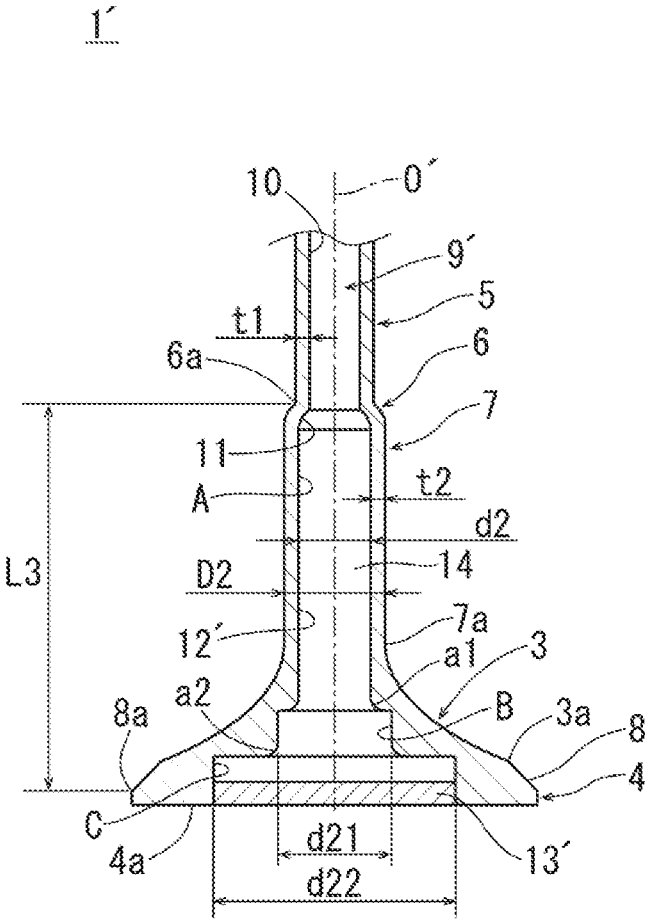
FIG. 2 is an axial cross-sectional view illustrating a modification of a second hollow part in the first embodiment.

FIG. 2 illustrates a modification of the second hollow part 12 of the first embodiment. The same elements as the first embodiment are denoted by the same reference numerals and will not be described. A second hollow part 12' illustrated in FIG. 2 is made up of a hollow part A having the inner diameter d2, a hollow part B having an inner diameter d21, and a hollow part C having an inner diameter d22. The inner diameter d2 of the hollow part A is the same as the inner diameter of the second hollow part 12 of FIG. 1. The hollow part B is formed inside the fillet 3, and the hollow part C is formed inside the head 4.

As illustrated in FIG. 2, the hollow parts A to C are formed in the shapes of multiple hollow parts different in inner diameter and continuously arranged from the base end part to the leading end part in ascending order of the inner diameter and formed coaxially around a central axis O' of the engine valve 1'. The hollow parts A to C have inner diameters satisfying the relationship d2<d21<d22. The hollow parts A to C are desirably formed such that the hollow parts are smoothly connected via convex curved parts a1, a2 as illustrated in FIG. 2 and/or tapered parts (not illustrated). Although connection portions of the hollow parts A to C may be straight holes, causing the connection to be achieved via curved parts and/or tapered parts will facilitate the movement of coolant between/among the hollow parts A to C.

The second hollow part 12' forms a hollow part 9' together with the first hollow part 10 and the curved part 11, and the hollow part 9' is closed by attaching a cap 13' made of a heat-resistant alloy or the like by resistance bonding or the like in such fashion that the interior thereof is made to contain a coolant such as metallic sodium. At the hollow exhaust poppet valve 1' of the present embodiment, the hollow parts A to C made up of straight holes having the respective different inner diameters d2, d21, d22 are formed in ascending order of the inner diameter, so that the second hollow part 12' can easily be formed from the leading end side of the valve, and since the amount of the coolant inside the second hollow part 12' that is exposed to high temperature is further increased, the rate of heat transfer capable of being achieved by the coolant 14 is further increased, making it possible for the cooling effect of the valve to be improved.

Although the second hollow part 12' of this modification was described in terms of an example in which this was divided into the three hollow parts A to C, the second hollow part 12' may be divided into two parts so as to reduce cost, or may be divided into four or more parts formed into shapes further following the contours of the fillet and the head so as to increase the capacity inside the second hollow part.

Although the hollow exhaust poppet valve 1 in the first embodiment illustrated in FIGS. 1 and 2 was described in terms of an example in which the wall thicknesses of the first and second stem parts (5, 7) satisfy t1=t2, in accordance with a variation thereon the wall thickness t2 of the second stem part 7 is desirably made greater than the wall thickness t1 of the first stem part 5 (i.e., t2>0). By so doing, an increase in the rate of heat transfer that can be achieved by the second stem part 7 itself may further improve the rate of heat transfer from the exhaust gas in the combustion chamber and the exhaust gas port to the coolant 14, so that the cooling effect due to the valve can be improved.

Figure 3:
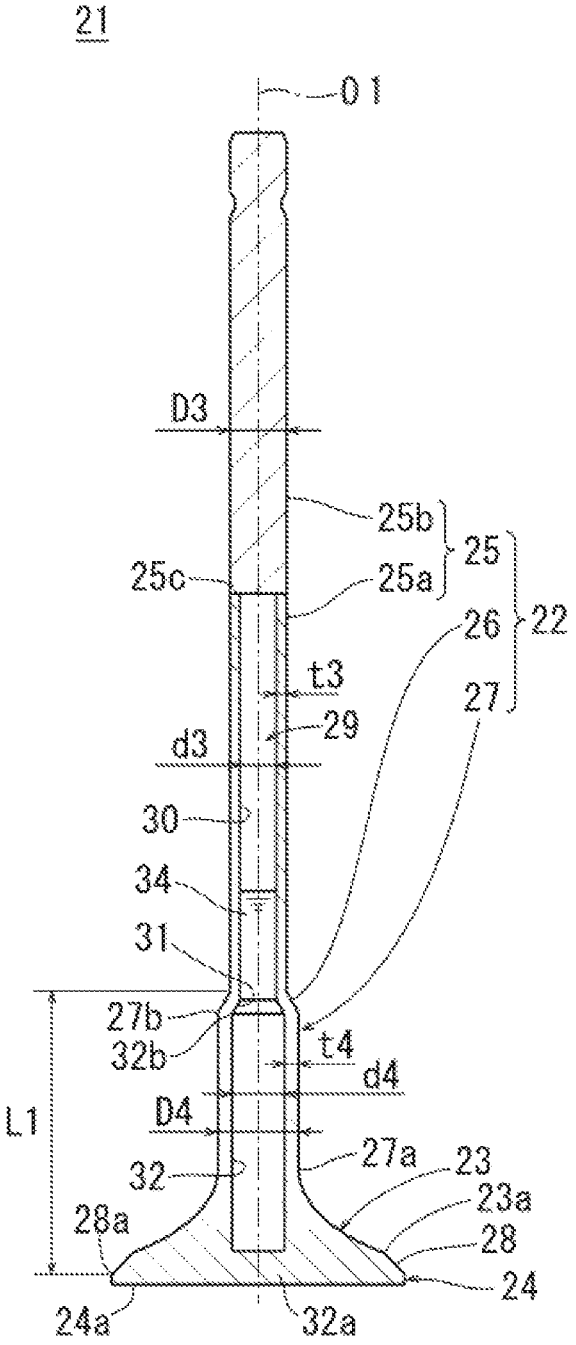
FIG. 3 is an axial cross-sectional view of a hollow exhaust poppet valve according to a second embodiment.
Figure 4:
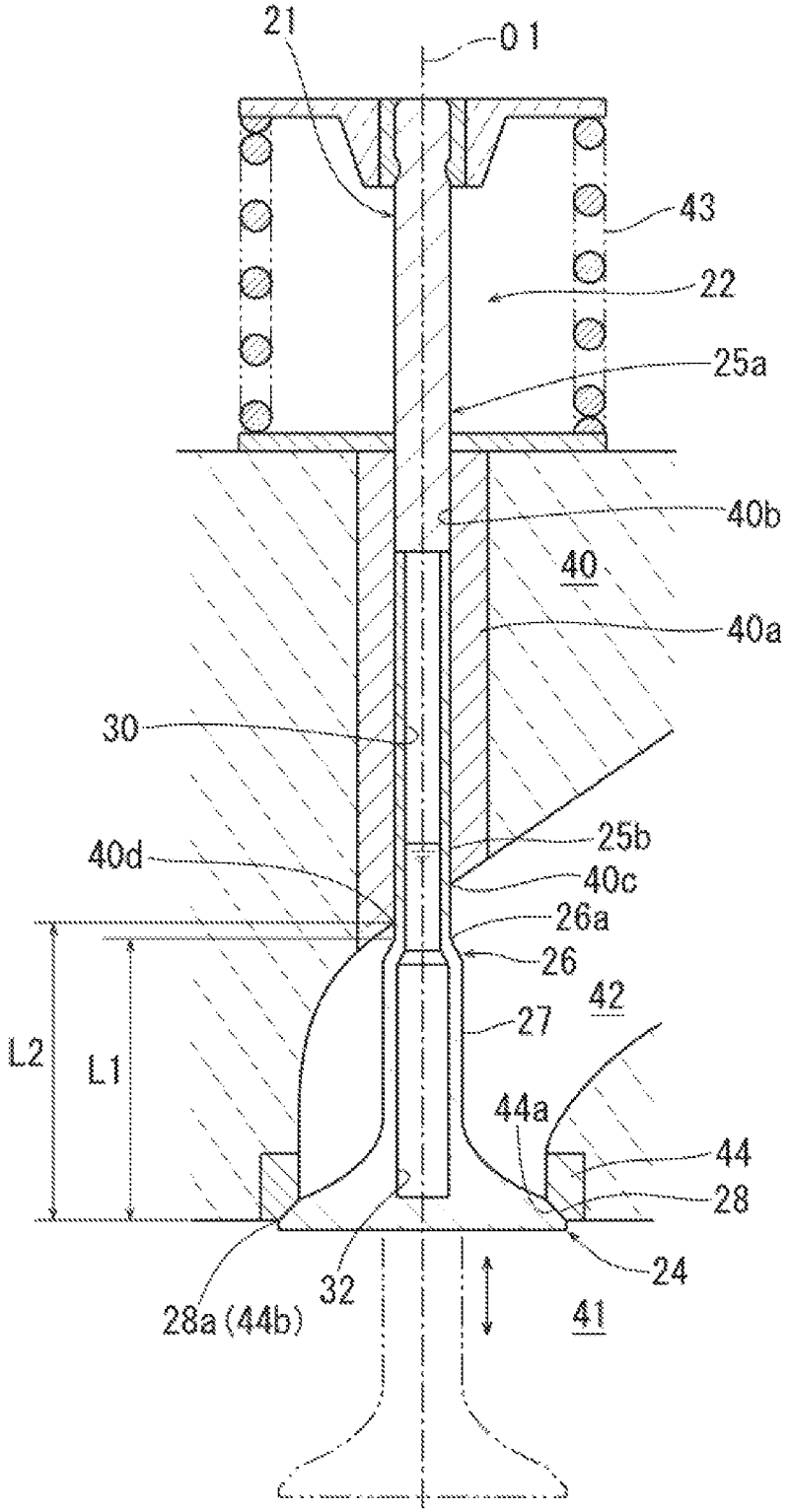
FIG. 4 is a longitudinal cross-sectional view of a hollow exhaust poppet valve of the second embodiment disposed in a cylinder head.

A second embodiment of the hollow exhaust poppet valve will be described with reference to FIGS. 3 and 4. In FIGS. 3 and 4, the head side and the stem side of the hollow exhaust poppet valve will be described as the leading end side and the base end side, respectively.

A hollow exhaust poppet valve 21 in the second embodiment illustrated in FIGS. 3 and 4 has the same outer shape as the hollow exhaust poppet valve 1 in the first embodiment and includes a stem 22, a fillet 23, and a head 24 made of a heat-resistant alloy(s) and/or the like having high heat resistance.

The stem 22 is made up of a first stem part 25, a step part 26, and a second stem part 27. The first stem part 25 is made up of a main body part 25*a* having a first hollow part 30, described below, and a solid stem end part 25*b* formed so as to have the same outer diameter D3 as the main body part 25*a* to form the hollow exhaust poppet valve 21. The second stem part 27 is integrated with the main body part 25*a* of the first stem part 25 via a taper-shaped step part 26 that tapers so as to become narrower as one proceeds from the leading end side to the base end side, and an outer diameter D4 of the second stem part 27 is made larger than the outer diameter D3 of the first stem part 25 overall due to the step part 26. The step part 26 may be formed as a curved part having a convex curved shape that becomes narrower as one proceeds from the leading end side to the base end side.

The fillet 23 is formed into a concave curved shape with an outer diameter gradually that increases toward a leading end and is smoothly connected to a leading end part 27*a* of the second stem part 27. The head 24 has a taper-shaped valve face 28 spreading out from the base end side to the leading end side on the outer circumference, and the valve face 28 is connected to a leading end part 23*a* of the fillet 23.

A hollow part 29 coaxial with a central axis O1 of the hollow exhaust poppet valve 21 is formed in the central portion inside the stem 22, the fillet 23, and the head 24. The hollow part 29 comprises a first hollow part 30, a tapered part 31, and a second hollow part 32. The first hollow part 30 is formed inside the main body part 25*a* of the first stem part 25 of the stem 22 in such fashion as to have a constant inner diameter, and the second hollow part 32 is formed inside the second stem part 27, the fillet 23, and the head 24 in such fashion as to have a constant inner diameter d4 larger than an inner diameter d3 of the first hollow part 30. The tapered part 31 may be alternatively or additionally be formed as a curved part having a concave curved shape that becomes narrower as one proceeds from the leading end side to the base end side.

The tapered part 31 has a shape that tapers so as to become narrower as one proceeds from the leading end side to the base end part, with a leading-end inner diameter of d4 and a base-end inner diameter of d3, and the second hollow part 32 is smoothly connected to the first hollow part 30 via the tapered part 31. The second hollow part 32 is formed into a bottomed cylindrical shape that does not penetrate bottom surface 24*a* but is separated from bottom surface 24*a* by bottom part 32*a* which is integral with the head 24.

The hollow exhaust poppet valve 21 has the first hollow part 30, the tapered part 31, and the second hollow part 32 which may be obtained by forming a solid poppet valve that includes a fillet and a head having the same shapes as the fillet 23 and the head 24 and that has a total axial length of the main body part 25*a* and the second stem part 27, forming a circular hole having an inner diameter d4 with a bottom formed about a central axis O1 from the base end part side of the solid poppet valve, using a drawing die at the outer circumference on the base end part of the formed hollow poppet valve to form a circular hole having an inner diameter d3 coupled via the tapered part 31 to the base end part side of the circular hole having the inner diameter d4, causing the hollow part 29 to be at least partially filled with a coolant 34, and finally axially bonding the stem end part 25*b* to a base end part 25*c* of the main body part 25*a* by resistance bonding or the like.

In the second embodiment, a wall thickness t4 of the second stem part 27 is made greater than a wall thickness t3 of the first stem part 25 (i.e., t4>t3), and an increase in the rate of heat transfer capable of being achieved by the second stem part 27 itself further improves the rate of heat transfer from the combustion chamber to the coolant 34, so that the cooling effect due to the valve is improved. The second stem part 27 has the second hollow part 32 formed inside in such fashion as to have an inner diameter larger than the first hollow part 30 of the first stem part 25, and also has a wall thickness which is greater than that of the first stem part 25, and therefore produces an effect of improving heat transfer characteristics due to increase in the rate of heat transfer achieved thereby and in the amount of coolant 34 while maintaining strength. Although the second stem part 27 may be formed such that the wall thickness t4 of the second stem part 27 is the same as the wall thickness t3 of the first stem part 25, the second stem part 27 is desirably formed so as to have a wall thickness greater than the first stem part so as to increase the rate of heat transfer that is capable of being achieved by the second stem part 27 itself.

In the hollow exhaust poppet valve 21 according to the second embodiment (and also in the hollow exhaust poppet valve 1 according to the first embodiment), a base end part 32*b* of the second hollow part 32 is desirably made flush with a base end part 27*b* of the second stem part 27 in a direction along the central axis O1 of the valve. by so doing, it will be possible to cause the second hollow part 32 to be formed so as to have increased capacity inside the second stem part 27 which is exposed to the high temperature of the exhaust gas without reducing the strength of the step part 26 by biting into the inside of the step part 26 and reducing the wall thickness, so that the cooling effect due to the valve is further improved.

At the hollow exhaust poppet valve 21 of the second embodiment, the second hollow part 32 is disposed inside the second stem part 27, the fillet 23, and the head 24 exposed to high-temperature exhaust gas of a combustion chamber and an exhaust gas port of an engine and has the inner diameter d4 made larger than the inner diameter d3 of the first hollow part 30, so that while the second hollow part 32 is expanded in capacity to increase the amount of the coolant 34 with which this may be filled while increasing the rate of heat transfer that is capable of being achieved by the second stem part 27 which is exposed to high temperature, as a result of which heat may be smoothly transferred to the coolant 34 from exhaust gas in a combustion chamber 41 and an exhaust gas port 42, described below. Additionally, the coolant 34 is shaken back and forth along the central axis O1 of the valve inside the second hollow part 32 having the constant inner diameter d4 during fast oscillation of the hollow exhaust poppet valve 21 and therefore hardly remains on the inner wall of the second hollow part 32, so that smooth movement to and from the first hollow part 30 is facilitated via the tapered part 31 that tapers toward the first stem part 25 on the base end side and having the inner diameter at connection points made coincident with the first and second hollow parts (30, 32).

As a result, the hollow exhaust poppet valve 21 of the present embodiment is such that the efficiency of movement of the coolant 34 is improved between the head 24 and the stem 22, so that a cooling effect equivalent to or better than that of a hollow-head valve can be produced during low and/or medium rotational speeds of the engine, while the second hollow part 32 can easily be formed since the second hollow part 32 has a shape of a straight hole having the constant inner diameter d4.

FIG. 4 illustrates the hollow exhaust poppet valve 21 of the second embodiment disposed on a cylinder head 40 in such fashion as to be made to advance and retract between the combustion chamber 41 and the exhaust gas port 42 at the time of opening and closing during exhaust. The cylinder head 40 is provided with the exhaust gas port 42 opened toward a valve guide 40*a* and the combustion chamber 41. The valve guide 40*a* is provided with a valve insertion hole 40*b* with which the stem 22 of the hollow exhaust poppet valve 21 is in slidable contact, and a leading end of the valve insertion hole 40*b* opens into the exhaust gas port 42. The stem 22 of the hollow exhaust poppet valve 21 urged by a valve spring 43 in a valve closing direction (direction from the front end to the base end of the valve) is held in the valve insertion hole 40*b* and advances and retracts back and forth. The hollow exhaust poppet valve 21 is formed such that the valve slides in a leading end direction along the central axis O1 at the time of opening of the valve and that the valve face 28 of the valve head 24 comes into contact with a valve seat surface 44*a* of a valve seat 44 of the cylinder head 40 formed in an opening circumferential edge part of the exhaust gas port 42 due to an urging force of the valve spring 43 at the time of closing of the valve.

In the hollow exhaust poppet valve 21 of the second embodiment illustrated in FIG. 4, a length L1 in the direction along the central axis O1 from a base end part 26*a* of the step part 26 to a leading end part 28*a* of the valve face 28 is desirably made shorter than an axial length L2 from a leading edge part 40*d* of a valve guide opening part 40*c* of the cylinder head 40 to a leading end part 44*b* of the valve seat 44, and in the hollow exhaust poppet valve 1 of the first embodiment illustrated in FIGS. 1 and 2, a length L3 in the direction along the central axis O from a base end part 6*a* of the step part 6 to a leading end part 8*a* of the valve face 8 is desirably made shorter than the axial length L2 from the leading edge part 40*d* of the valve guide opening part 40*c* to the leading end part of the valve seat when it is assumed that the hollow exhaust poppet valve 1 is disposed on the cylinder head 40 of FIG. 4.

When the hollow exhaust poppet valve (1, 21) is formed in this way, the base end part (6*a*, 26*a*) of the step part (6, 26) is located lower than the leading edge part 40*d* of the valve guide opening part of the cylinder head at the time of closing of the valve, so that the step part (6, 26) and the second stem part (7, 27) do not interfere with the valve guide opening part 40*c* of the cylinder head 40 at the time of opening/closing operation of the hollow exhaust poppet valve (1, 21) during exhaust. As a result, the capacity of the second hollow part (12, 32) and the wall thickness (t2, t4) of the second stem part (7, 27) can further be increased in the hollow poppet valve (1, 21), so that the rate of heat transfer from the combustion chamber to the coolant is further improved.

Figure 5:
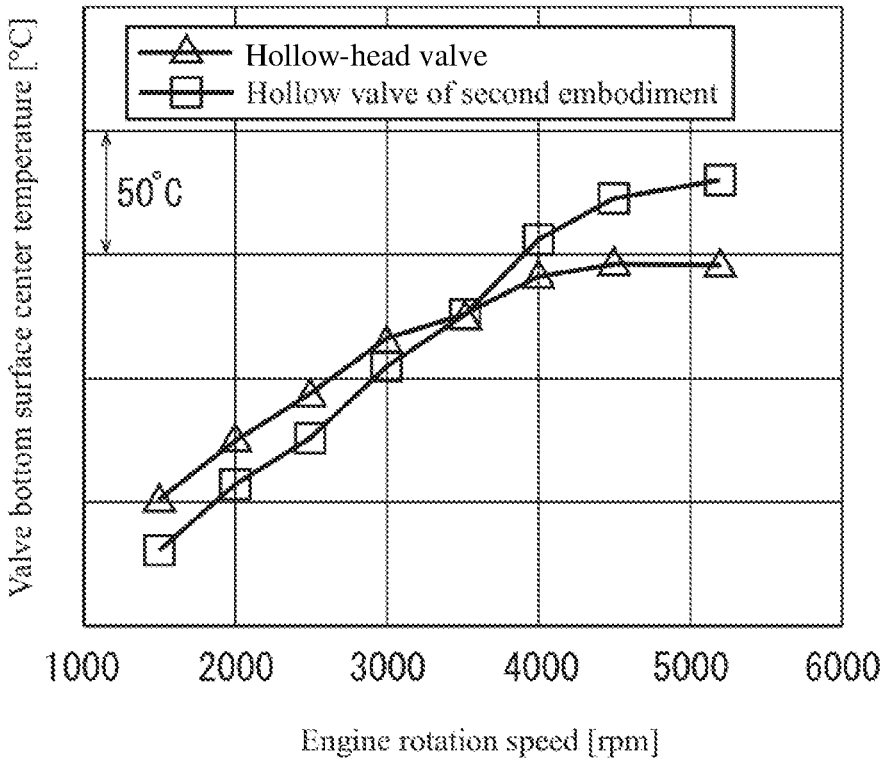
FIG. 5 is graphs illustrating temperature measurement results of the hollow exhaust poppet valve of the second embodiment, which are (a) a graph related to a center of a valve bottom surface and (b) a graph related to a valve fillet.
Figure 5:
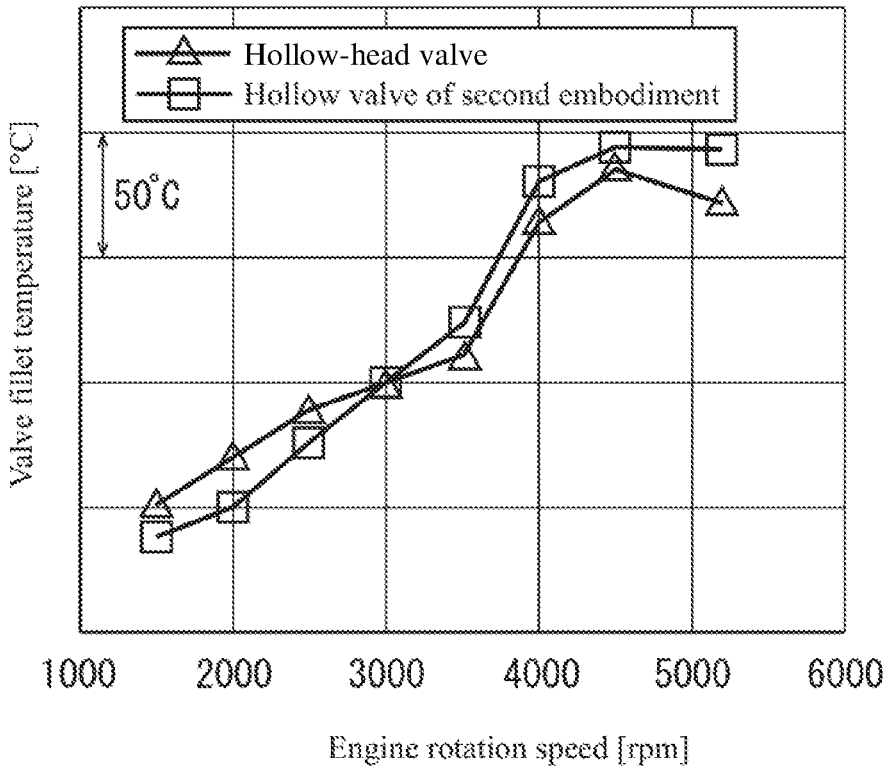

Description will be made of temperatures of the center of the bottom surface 24*a* of the valve head 24 and the fillet 23 of the valve as a function of rotational speed of an engine using the coolant-containing hollow poppet valve 21 of the second embodiment (see FIG. 3) measured by a thermocouple method with reference to (a) and (b) at FIG. 5. (a) at FIG. 5 is a graph for the center of the bottom surface 24*a* of the valve, and (b) at FIG. 5 is a graph for the fillet 23 of the valve. The figures each include a horizontal axis indicative of the rotational speed (rpm) of the valve, a vertical axis indicative of temperature (° C.), a line of triangles indicative of the temperature of a coolant-containing hollow-head valve not employing the features of the second embodiment, and a line of squares indicative of the temperature of a coolant-containing hollow poppet valve in accordance with the second embodiment.

At (a) in FIG. 5, the bottom surface temperature of the head of the coolant-containing hollow valve of the present embodiment is on par with that of a coolant-containing hollow-head valve when the rotational speed of the engine is about 3500 rpm. Although the bottom surface temperature of the hollow valve of the present embodiment is slightly higher than that of a hollow-head valve when the engine rotates at high speeds exceeding about 3500 rpm, the temperature is kept lower than that of a hollow-head valve when the engine rotates at low and/or medium rotational speeds of 3500 rpm or less.

At (b) in FIG. 5, the fillet temperature of the engine valve of the present embodiment is on par with that of a hollow-head valve not employing the features of the present embodiment when the rotational speed of the engine is about 3000 rpm. Although the fillet temperature of the engine valve of the present embodiment is slightly higher than that of a hollow-head valve when the engine rotates at high speeds exceeding about 3000 rpm, the fillet temperature of the hollow valve of the present embodiment is kept lower than that of a hollow-head valve when the engine rotates at low and/or medium rotational speeds of 3000 rpm or less.

As described above, from the measurement results of (a) and (b) in FIG. 5, it can be said that while a coolant-containing hollow-head valve produces good cooling effect during high-speed rotation of the engine, the hollow exhaust poppet valve of the present embodiment produces good cooling effect which is equivalent to or better than that of a hollow-head valve during low and/or medium rotational speeds of the engine, thereby improving knock resistance and contributing to improvement in fuel efficiency.

Metallic sodium which may be used as a coolant for hollow valves has a melting point of 98° C. A coolant-containing hollow valve receiving heat from a combustion chamber during low and/or medium rotational speeds of an engine does not reach as high a temperature as it does during high-speed rotation, and therefore, when metallic sodium serving as coolant within the hollow part of a hollow-head valve moves from a region inside the valve head and the valve fillet which is exposed to the combustion chamber to a region near a stem end part which is not exposed to the combustion chamber and therefore having a lower temperature, the metallic sodium is cooled to the melting point or less and tends to agglomerate in regions near the stem end part such that movement thereof is hindered, which may cause deterioration of valve performance with respect to dissipation of heat from the head and the fillet to the stem. However, with the coolant-containing hollow valve of the present embodiment, because the inner diameter of the first hollow part 10 near the stem end part is smaller than the inner diameter of the second hollow part 12, it is thought that even if some coolant agglomerates in regions near the stem end part, the amount thereof that agglomerates thereat will be decreased and the deterioration in performance with respect to heat dissipation will be reduced, making it possible for the temperature of the valve to be reduced even when the engine is operating in the low and/or medium rotational speed range.

Therefore, the hollow exhaust poppet valve of the present embodiment produces excellent cooling effect particularly when used for engines that operate only in the low and/or medium rotational speed range, such as an engine that generates electric power for use by a drive motor of an electric vehicle.

EXPLANATION OF REFERENCE NUMERALS

1 Exhaust hollow poppet valve
2 Stem
3 Fillet
4 Valve head
5 First stem part
6 Step part
7 Second stem part
8 Valve face
9 Hollow part
10 First hollow part
11 Curved part
12 Second hollow part
14 Coolant
21 Hollow exhaust poppet valve
22 Stem
23 Fillet
24 Valve head
25 First stem part
26 Step part
27 Second stem part
28 Valve face
29 Hollow part
30 First hollow part
31 Tapered part
32 Second hollow part
34 Coolant
40 Cylinder head
40*c* Valve guide opening part
40*d* Leading edge part
44 Valve seat
L1, L3 Axial length from a base end part of a step part to a leading end part of a valve face
L2 Axial length from a leading edge part of a valve guide opening part to a leading end of a valve face

What is claimed is:

1. A hollow exhaust poppet valve including a stem and a head integrated via a fillet that increases in diameter toward a leading end of the valve, the valve having a coolant disposed within a hollow part that extends from the head to the stem, wherein the stem includes a first stem part disposed toward a base end of the valve which is opposite the leading end, and a second stem part integrated with the first stem part via a step part constituting an exterior surface transition between the first and second stem parts, the second stem part integrated with the fillet, and having a wall thickness and an outer diameter that is larger than that of the first stem part, and wherein the hollow part includes a first hollow part formed inside the first stem part, and a second hollow part formed inside the second stem part, the fillet, and the head such that the second hollow part has a constant inner diameter that extends along the second stem part and into the head, wherein the constant inner diameter of the second hollow part is larger than an inner diameter of the first hollow part, and the second hollow part is formed so as to be continuous with the first hollow part via a connecting portion constituting an interior surface transition between the first and second hollow parts.

2. The hollow exhaust poppet valve according to claim 1, wherein the second hollow part is contiguous with at least one third hollow part of constant inner diameter, the second hollow part and the at least one third hollow part being arranged in an ascending order of inner diameter in a direction from the base end of the valve and toward the leading end of the valve.

3. The hollow exhaust poppet valve according to claim 2, wherein the connecting portion is one among a plurality of connecting portions by way of which the hollow parts different in inner diameter are respectively made continuous.

4. The hollow exhaust poppet valve according to claim 3, wherein the head of the valve has a valve face configured to come into contact with a valve seat at a time of closing the valve, and wherein an axial length from a portion of the step part which is nearest to the base end of the valve to a portion of the valve face which is nearest to the leading end of the valve is made shorter than an axial length from a portion of a valve guide opening part of a cylinder head which is nearest to the leading end of the valve to a portion of the valve seat which is nearest to the leading end of the valve at the time of closing the valve.

5. The hollow exhaust poppet valve according to claim 3, wherein at least one of the connecting portions is a tapered part.

6. The hollow exhaust poppet valve according to claim 3, wherein at least one of the connecting portions is a curved part.

7. The hollow exhaust poppet valve according to claim 2, wherein the head of the valve has a valve face configured to come into contact with a valve seat at a time of closing the valve, and wherein an axial length from a portion of the step part which is nearest to the base end of the valve to a portion of the valve face which is nearest to the leading end of the valve is made shorter than an axial length from a portion of a valve guide opening part of a cylinder head which is nearest to the leading end of the valve to a portion of the valve seat which is nearest to the leading end of the valve at the time of closing the valve.

8. The hollow exhaust poppet valve according to claim 1, wherein the head of the valve has a valve face configured to come into contact with a valve seat at a time of closing the valve, and wherein an axial length from a portion of the step part which is nearest to the base end of the valve to a portion of the valve face which is nearest to the leading end of the valve is made shorter than an axial length from a portion of a valve guide opening part of a cylinder head which is nearest to the leading end of the valve to a portion of the valve seat which is nearest to the leading end of the valve at the time of closing the valve.

9. The hollow exhaust poppet valve according to claim 1, wherein the connecting portion is a tapered part.

10. The hollow exhaust poppet valve according to claim 1, wherein the connecting portion is a curved part.

* * * * *